US008011342B2

(12) United States Patent
Bluhm

(10) Patent No.: US 8,011,342 B2
(45) Date of Patent: Sep. 6, 2011

(54) WET OIL SUMP FOR FOUR CYCLE ENGINE

(75) Inventor: Michael John Bluhm, Osceola, WI (US)

(73) Assignee: Polaris Industries Inc., Medina, MN (US)

( * ) Notice: Subject to any disclaimer, the term of this patent is extended or adjusted under 35 U.S.C. 154(b) by 489 days.

(21) Appl. No.: 12/218,528

(22) Filed: Jul. 16, 2008

(65) Prior Publication Data

US 2010/0012075 A1 Jan. 21, 2010

(51) Int. Cl.
*F01M 11/10* (2006.01)

(52) U.S. Cl. ..... 123/196 R; 184/6.5

(58) Field of Classification Search ..... 123/195 R, 123/195 S, 196 R, 196 S; 184/6.2, 6.5, 6.13
See application file for complete search history.

(56) References Cited

U.S. PATENT DOCUMENTS

| | | | | |
|---|---|---|---|---|
| 1,456,461 | A * | 5/1923 | Page | 184/6.28 |
| 1,891,726 | A * | 12/1932 | Radford | 184/6.24 |
| 2,135,247 | A * | 11/1938 | Aikman | 417/281 |
| 2,741,236 | A * | 4/1956 | Altman et al. | 123/195 A |
| 2,799,139 | A * | 7/1957 | Becker | 123/196 R |
| 4,346,786 | A | 8/1982 | Midgley | |
| 4,519,348 | A | 5/1985 | Hamilton | |
| 4,616,609 | A | 10/1986 | Munch et al. | |
| 4,909,203 | A | 3/1990 | Fukuo | |
| 4,938,184 | A | 7/1990 | Martin et al. | |
| 5,103,782 | A | 4/1992 | Matsui | |
| 5,240,088 | A | 8/1993 | Okui et al. | |
| 5,257,674 | A | 11/1993 | Okui et al. | |
| 5,664,537 | A | 9/1997 | Beranek et al. | |
| 6,374,794 | B1 | 4/2002 | Dudemaine | |
| 6,568,509 | B1 | 5/2003 | Suglura | |

FOREIGN PATENT DOCUMENTS

| | | | |
|---|---|---|---|
| JP | 63075306 A | * | 4/1988 |
| JP | 2002174105 A | * | 6/2002 |

* cited by examiner

*Primary Examiner* — Noah Kamen
(74) *Attorney, Agent, or Firm* — Baker & Daniels LLP

(57) ABSTRACT

An oil pump assembly is shown for wet oil sump applications at extreme angles for power sports equipment. The oil pump is comprised of a pump body, an oil pick-up and a driven gear shield, where these components may be integrally formed from die cast aluminum. The pump body includes a rotor body housing a gerotor assembly for pumping. The oil pump is attached to the rear wall of the crankcase and below the crankshaft, and is driven by the crankshaft.

25 Claims, 13 Drawing Sheets

WET OIL SUMP FOR FOUR CYCLE ENGINE

FIELD OF INVENTION

The subject invention relates to a wet oil sump system for four cycle engines, with particular use in power sports vehicular applications.

BACKGROUND OF THE INVENTION

Lubrication systems in four cycle engines typically take one of two approaches, the first, a "wet oil sump" has a pool of oil at the bottom of the crankcase or oil pan together with an oil sump that siphons oil from the sump; or second, a "dry sump" which has an extra oil tank provided outside of the engine with an internal pump to distribute the oil to the engine. In either system, oil is distributed to lubricate such items as the main bearings of the crankshaft, the pistons and cylinder walls, connecting rods, cam shaft bearings, valves, and the like. In either the "wet sump" or "dry sump" system, oil is distributed through the various points and returned to the sump in a relatively closed loop system.

In the power sports industry, for example in four cycle engines that power snowmobiles and ATVs, the engines need to operate at extreme angles as the vehicles ascend and descend at a multitude of extreme angles. In this working environment, there has heretofore been tradeoffs between the wet oil sump and the dry oil sump methodology. As a dry sump system utilizes a closed volume for housing the lubricating oil, the volume of oil required to supply the system is less however the system is more complex as it requires an extra reservoir. The dry sump system however is less sensitive to the angles at which it operates and is therefore sometimes desired for extreme angles.

Wet oil sumps on the other hand, are easier to design as the engines are simply designed to allow the oil reservoir to pool at the bottom of the engine crankcase to create the oil sump. Due to the angle changes of the engine during the traversing of the vehicle, however, a larger volume of oil is required to ensure that the level of the oil is always maintained at or above the oil pump pickup.

Other shortcomings of present oil supply systems are also addressed in this disclosure. Most oil pumps are driven by a drive gear in meshing engagement with the crankshaft and the drive gear simply rotates within the pool of oil in the oil sump. This location of the drive gear within the oil sump may produce disadvantages to the overall system for a number of reasons. First, extra horsepower is required to drive the drive gear through the oil sump due to the resistance of the gear traveling in the oil. Second, the gear driven within the oil aerates the oil which in turn causes a decrease in the lubrication effect of the oil due to the air within the oil. Thirdly, driving the drive gear through the oil heats the oil which then in turn places a larger load on the oil cooler which may also cause an overall reduction in horse power.

SUMMARY OF THE INVENTION

In a first embodiment, an engine and pump assembly comprises a crankcase having a crankcase wall with an opening therethrough, an oil pump body, a pumping member and an oil pump cap, with the oil pump body and pumping member positioned internally of the crankcase wall. The oil pump cap is positioned externally of the crankcase wall. The oil pump body has a sump member extending into an oil reservoir, and a pump case to receive the pumping member.

In another embodiment, an oil pump assembly comprises an oil pump body for insertion within a crankcase. The oil pump body has an integral oil sump member extending into an oil reservoir, and an integral pump case. A pumping member is receivable in the pump case, and is profiled to pump oil upon rotation thereof.

In yet another embodiment, an oil pump assembly comprises an oil pump body and an oil pump case for insertion within a crankcase; an oil sump member for extending into an oil reservoir; a pumping member receivable in the pump case, and being profiled to pump oil upon pumping movement thereof. A drive gear drives the pumping member and a drive gear shield at least partially surrounds the drive gear and prevents the drive gear from being submersed into oil in the oil reservoir.

DETAILED DESCRIPTION OF THE EMBODIMENTS

Figure 1:
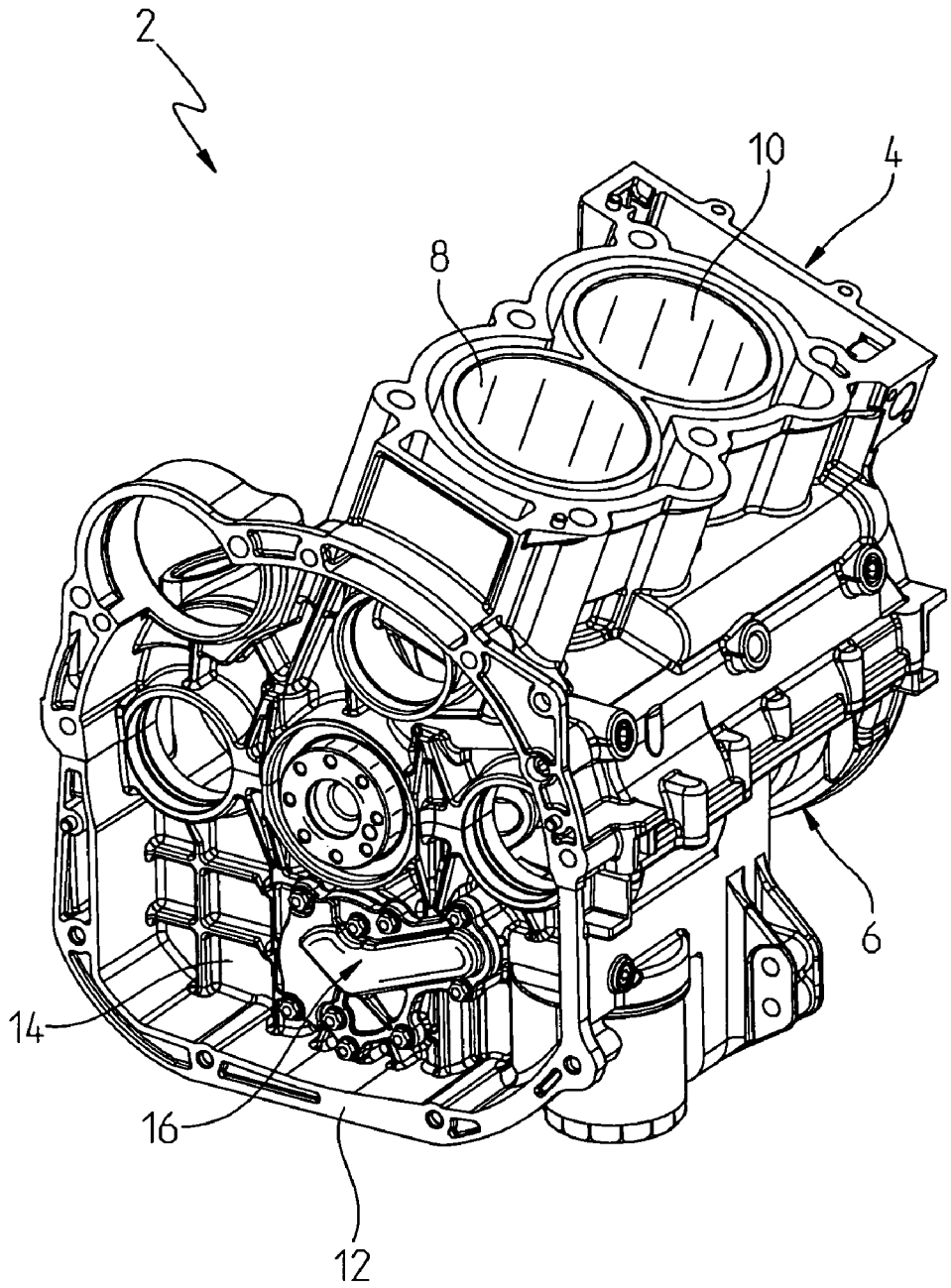
FIG. 1 is a perspective view of a two cylinder four cycle engine shown from a drive side.
Figure 2:
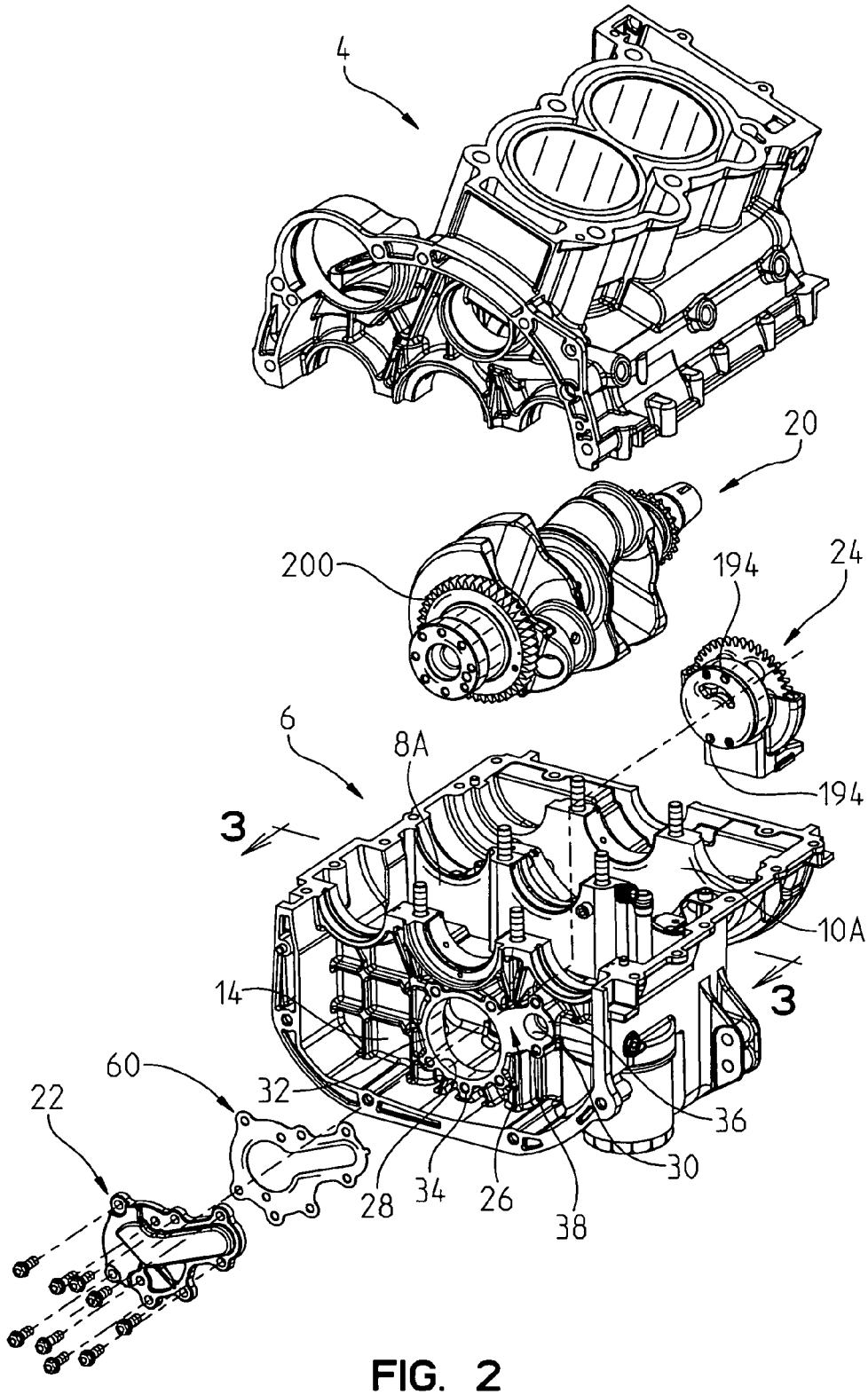
FIG. 2 shows a partially exploded view of the four cycle engine of FIG. 1.

With reference first to FIGS. 1 and 2, a four cycle in-line two cylinder engine is shown at 2 comprised of an engine head 4 and an engine crankcase at 6. Engine head 4 includes first and second cylinders 8, 10 (and crankcase compartments, 8A, 10A (FIG. 2)), and a bell housing 12 defined by a combination of head 4 and crankcase 6. Crankcase 6 includes a rear wall 14 to which an oil pump assembly 16 is attached as described further herein. Engine head 4 and crankcase 6 may be comprised of a hypereutectic aluminum alloy material (similar to that disclosed in U.S. Pat. No. 5,253,625, which is incorporated herein by reference) however where the cylinder bores are honed and polished to a point where the silicon is proud of the remaining surface material in the bore.

Figures 2A, 2B:
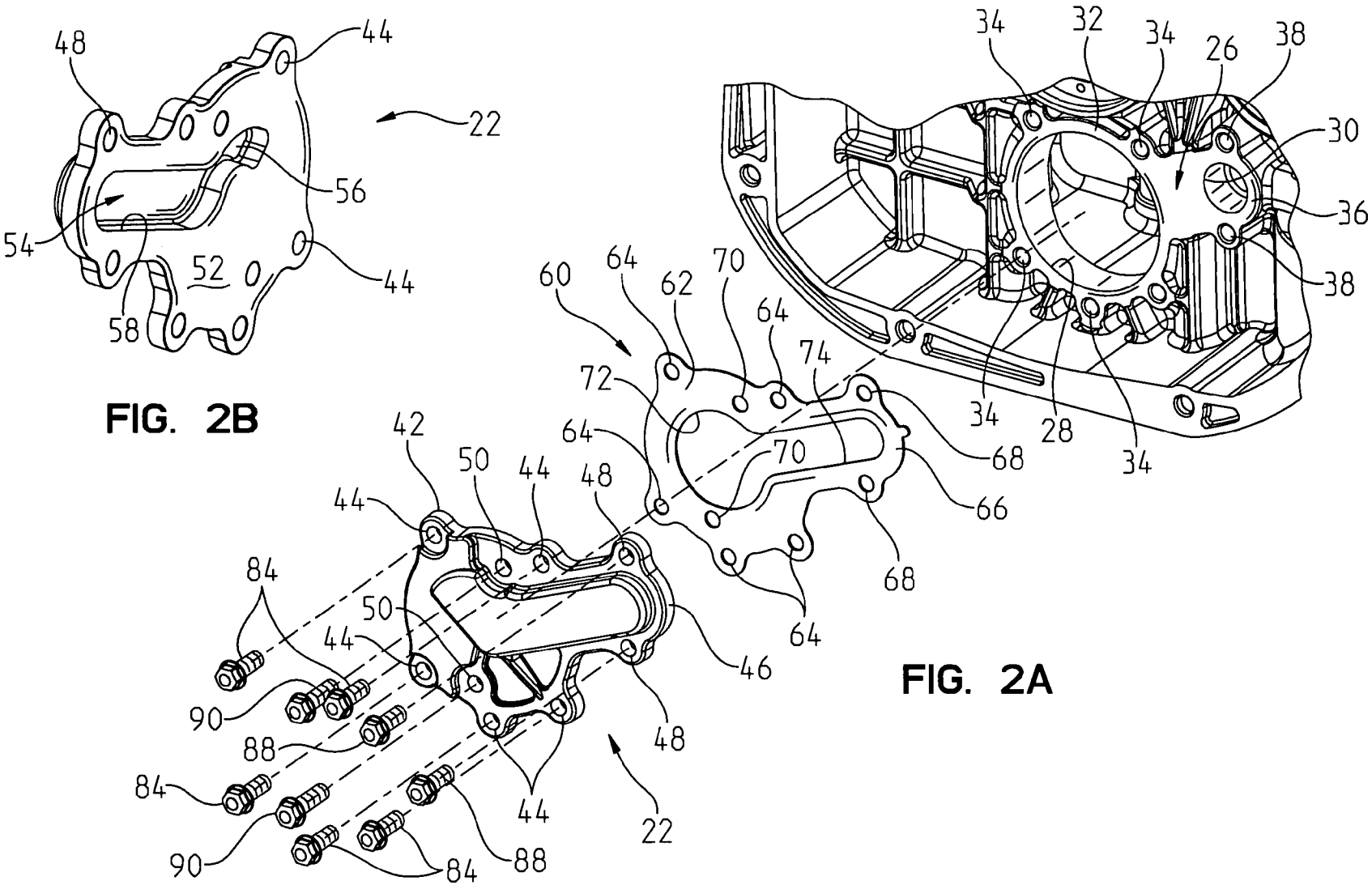
FIG. 2A is an enlarged view of a portion of the four cycle engine of FIG. 2.
FIG. 2B shows an enlarged inner perspective view of the outer cap of the oil pump assembly shown in FIG. 2A.

With reference now to FIGS. 2 and 2A, head 4 is shown exploded away from crankcase 6, with crankshaft 20 also shown removed. Oil pump assembly 16 is also shown exploded away from the crankcase and includes an outer cap 22 and an inner oil pump 24, as described further herein. Rear wall 14 is shown including a mounting area 26 which is comprised of a mounting bore 28 and a supply opening at 30. Bore 28 has a flange 32 in surrounding relation with a plurality of threaded openings at 34. Meanwhile opening 30 includes a flange at 36 having threaded openings at 38. Outer cap 22 includes a flange 42 having openings 44 aligned with openings 34, and flange 46 having openings 48 aligned with threaded openings 38. Apertures 50 are provided for mounting the pump 24 within bore 28 as will be described herein.

As also shown in FIG. 2A, gasket 60 is provided having gasket portion 62 for alignment with flange portions 32, 42; apertures 64 for alignment with apertures 34, 44; gasket portion 66 for alignment with flange portions 36, 46; and apertures 68 for alignment with apertures 38, 48. Gasket 60 further includes apertures 70 for alignment with apertures 50, and includes a central opening at 72 and an elongate opening at 74 as described herein. Finally, pump assembly 16 includes a plurality of fasteners, fasteners 84 for receipt through apertures 44, fasteners 88 for receipt through apertures 48 and fasteners 90 receivable through apertures 50. With reference now to FIG. 2B, oil cap 22 includes an inside surface at 52 having defined therein an oil channel 54 defining a discharge channel 56 and a supply channel 58.

Figure 3:
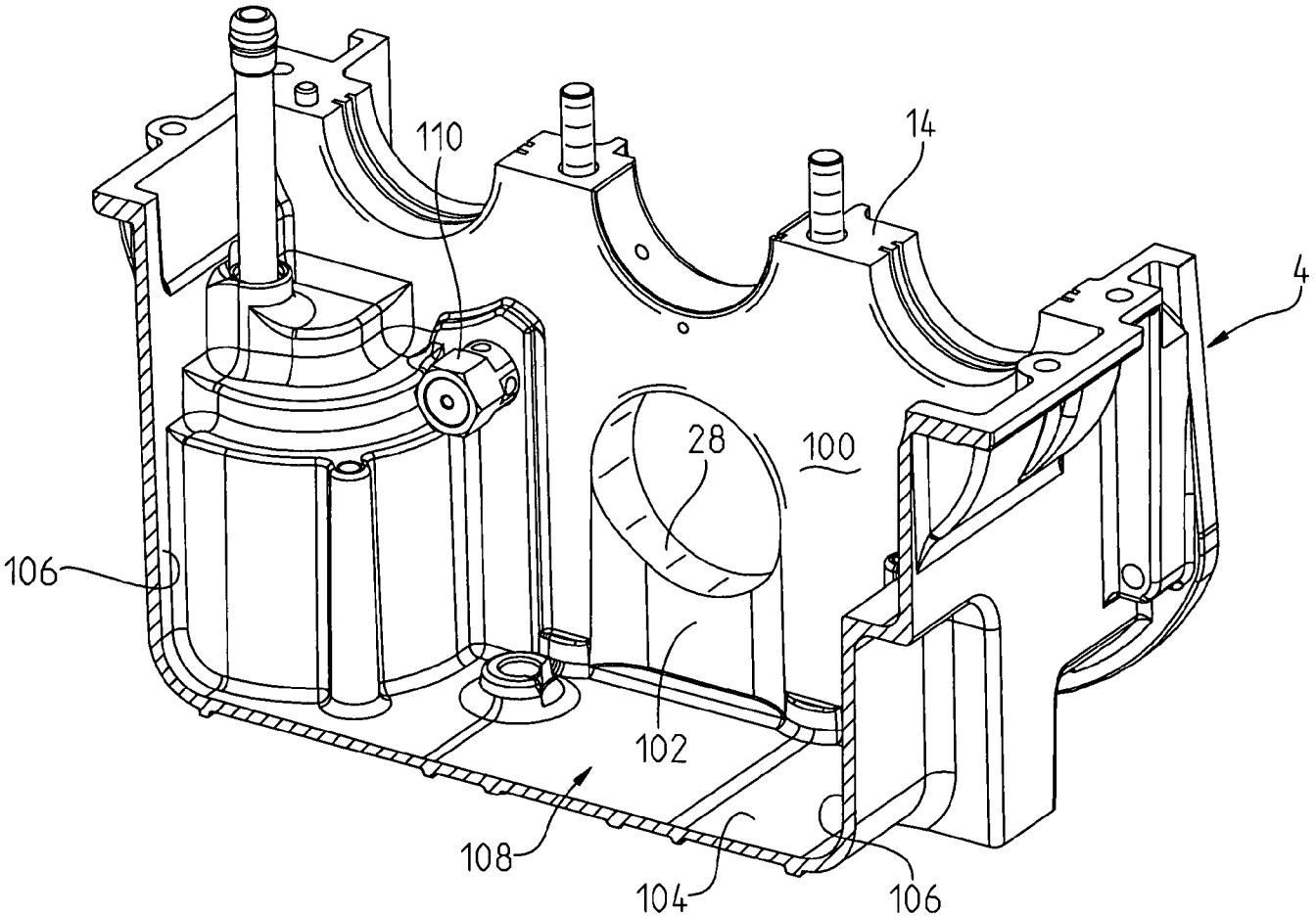
FIG. 3 shows a cross-sectional view through lines 3-3 of FIG. 2.

With reference now to FIG. 3, an inside of the crankcase 6 is shown, where rear wall 14 includes an inside surface at 100 having a recess at 102 positioned just below mounting bore 28. Crankcase 6 also includes a lower surface at 104 and upright surfaces 106 which would together define oil sump 108. Supply opening 30 (FIG. 2A) would be in fluid communication with oil regulator 110 as further described herein.

Figure 4:
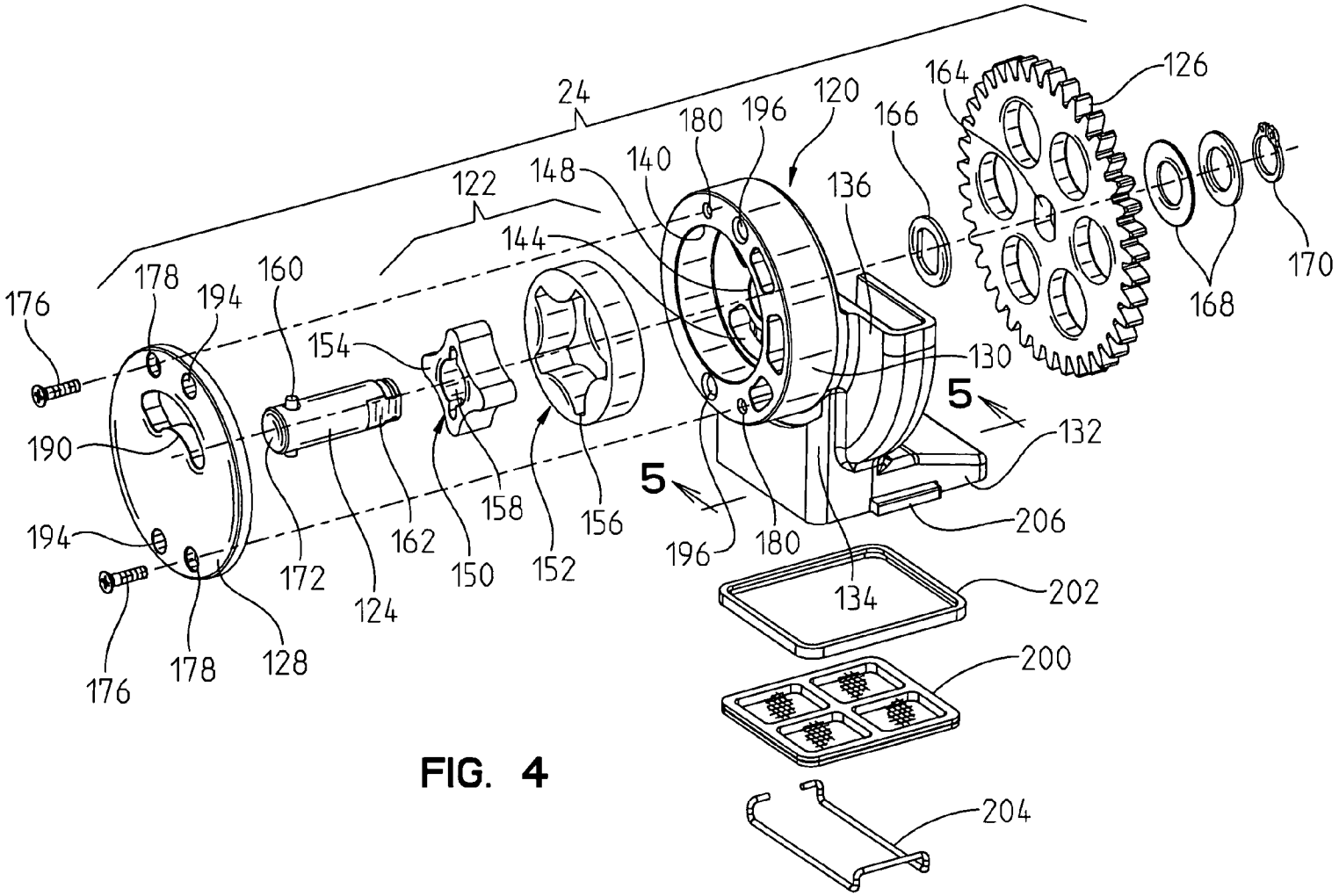
FIG. 4 is an exploded view of the oil pump.
Figure 5:
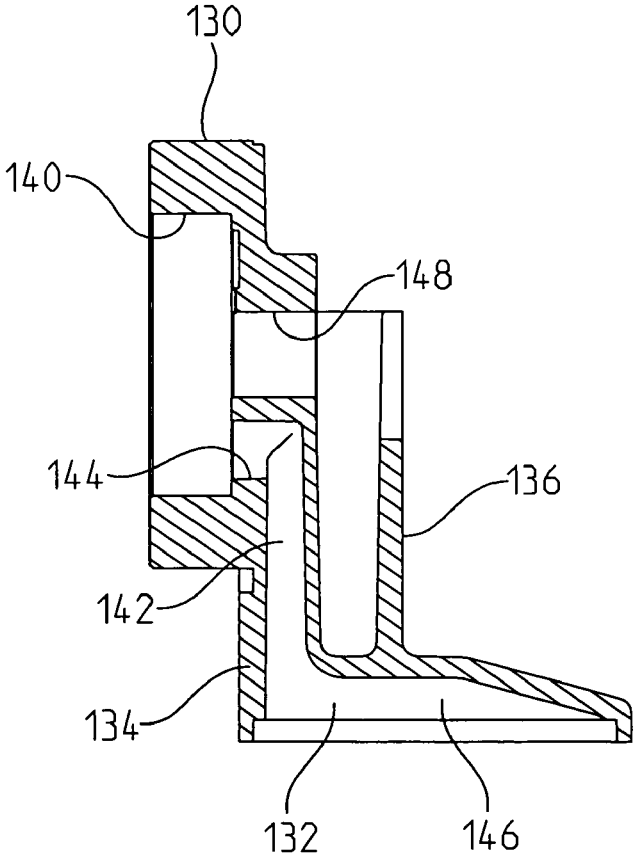
FIG. 5 is a cross-sectional view through lines 5-5 of FIG. 4.

With reference now to FIG. 4, oil pump 24 will be described in greater detail. Pump 24 is generally comprised of a pump housing 120, a gerotor assembly 122, a drive shaft 124, a driven gear 126 and a pump cover 128. With reference now to FIGS. 4 and 5, pump housing 120 will be described in greater detail. Pump housing 120 is comprised of an integrated die cast aluminum member which includes a rotor housing 130, an oil pickup 132, an upright housing portion 134 and a gear shield 136. As shown best in FIG. 5, rotor housing 130 includes an internal diameter at 140 to receive the gerotor assembly 122 and further includes an internal passage way 142 defined within the upright passageway 134 which communicates with discharge opening 144. Finally, pickup 132 includes a volume 146 and pump housing 120 includes a central aperture 148 provided for receiving drive shaft 124 as described herein.

As shown in FIG. 4, gerotor assembly 122 includes an inner rotor 150 and an outer rotor 152. Inner rotor 150 includes gear teeth 154 whereas outer rotor includes mating teeth 156. It should be appreciated that according to the gerotor geometry, outer rotor 152 includes one more tooth than inner rotor 150 thereby defining a vacuum/suction side and a pressure/discharge side upon rotation of the inner and outer rotor together within internal diameter 140. Inner rotor also includes a slotted opening at 158 which, as should be understood, receives pin 160 and shaft 124.

Figure 4A:
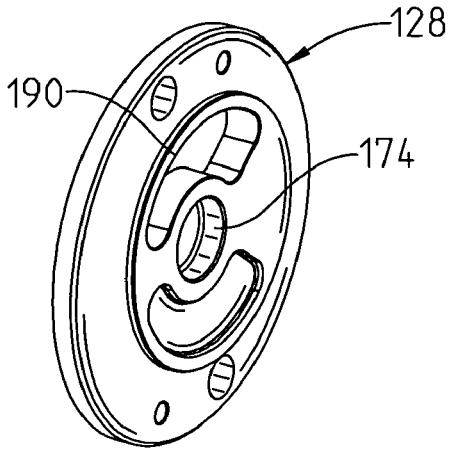
FIG. 4A is a perspective view of the oil pump cover, from an opposite side as that viewed in FIG. 4.

Thus to assemble pump 24, shaft 124 is positioned within aperture 158 of inner rotor 150 and inner rotor 150 is positioned within outer rotor 152. Driven gear 126 is now be positioned within drive shield 136 and shaft 124, together with inner and outer rotors 150, 152, is positioned through aperture 148 with drive shaft flattened portion 162 received in the corresponding opening 164 of driven gear 126. It should be appreciated that driven gear 126 is held to shaft 124 by way of suitable fasteners, such as a thrust washer 166, together with flat washers 168 and snap ring 170. At this point, pump cover 128 can be positioned over rotor housing 130 with free end 172 of shaft 124 being journalled in aperture 174 (FIG. 4A) of pump cover 128. Fasteners 176 can be positioned through apertures 178 and received in threaded openings 180 in rotor housing 130. This positions the discharge slot 190 in pump cover 128 in position to the pressure/discharge side of the gerotor assembly 122 as described above. This also positions apertures 194 in position over threaded bosses 196 as will be described in further detail herein. Finally, a filter 200 can be held to the oil pickup 132 by way of an insert 202 and a spring clip 204 attached to lugs 206 (only one of which can be viewed in FIG. 4).

Figure 6:
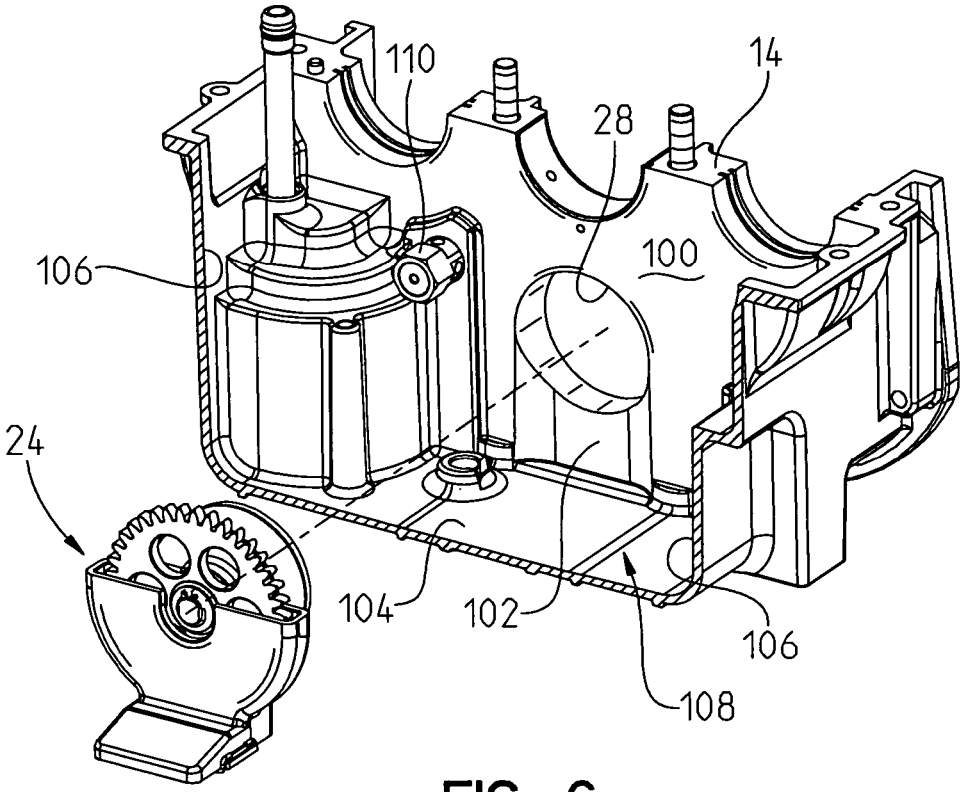
FIG. 6 is a view similar to that of FIG. 3 showing the oil pump exploded away from the engine crankcase.

With reference now to FIGS. 2 and 6, with the pump 24 as assembled, pump 24 is receivable into crankcase cavity 8*a*, which corresponds to cylinder 8 (FIG. 2). Pump 24 is receivable in bore 28 as shown. As mentioned above, pump cap 22 and gasket 60 are receivable over mounting area 26 and as shown in FIG. 2A, and pump cap 22 is held in place by fasteners 84 and 88. With the pump 24 so positioned, apertures 50 in pump cap 22 align with apertures 194 (FIG. 4) in pump cover 128, and threaded openings 196 of pump body 120 (FIG. 4), and fasteners 90 received through apertures 50 pull the entire pump assembly 24 forward into gasket 60, which in turn is trapped between pump cover 128 and surface 52 (FIG. 2B) of pump cap 22. It should be appreciated then that the gasket 60 has two separate functions, firstly to seal the connection between the pump cap 22 with the mounting area 26 and secondly, to seal the connection of the pump 24 relative to the pump cap 22.

Figure 7:
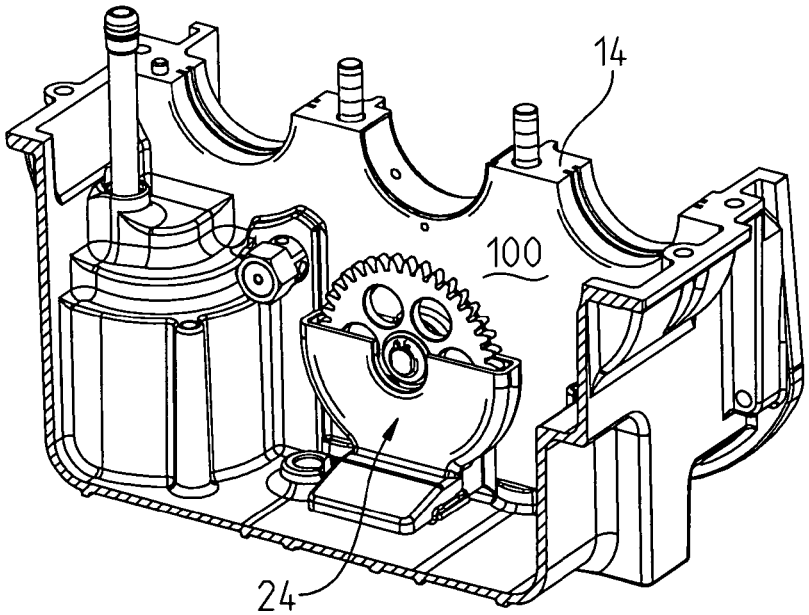
FIG. 7 is a view similar to that of FIG. 6 showing the oil pump attached to the engine crankcase.
Figure 8:
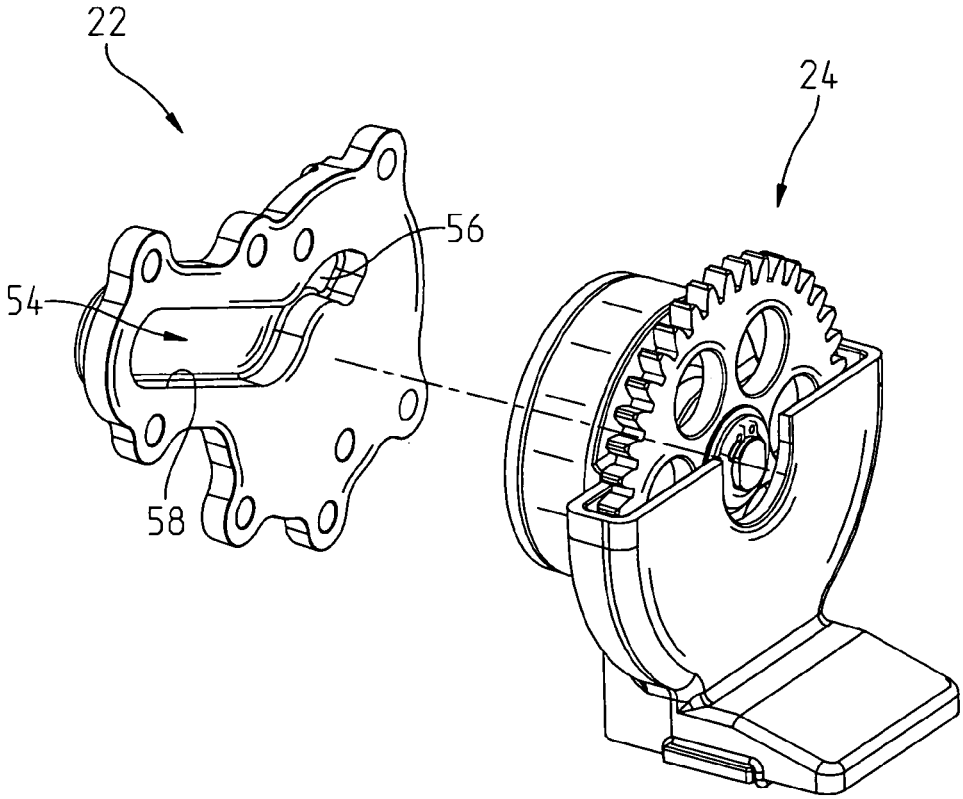
FIG. 8 shows a perspective view showing the interaction between the oil pump and the oil pump cover.
Figure 9:
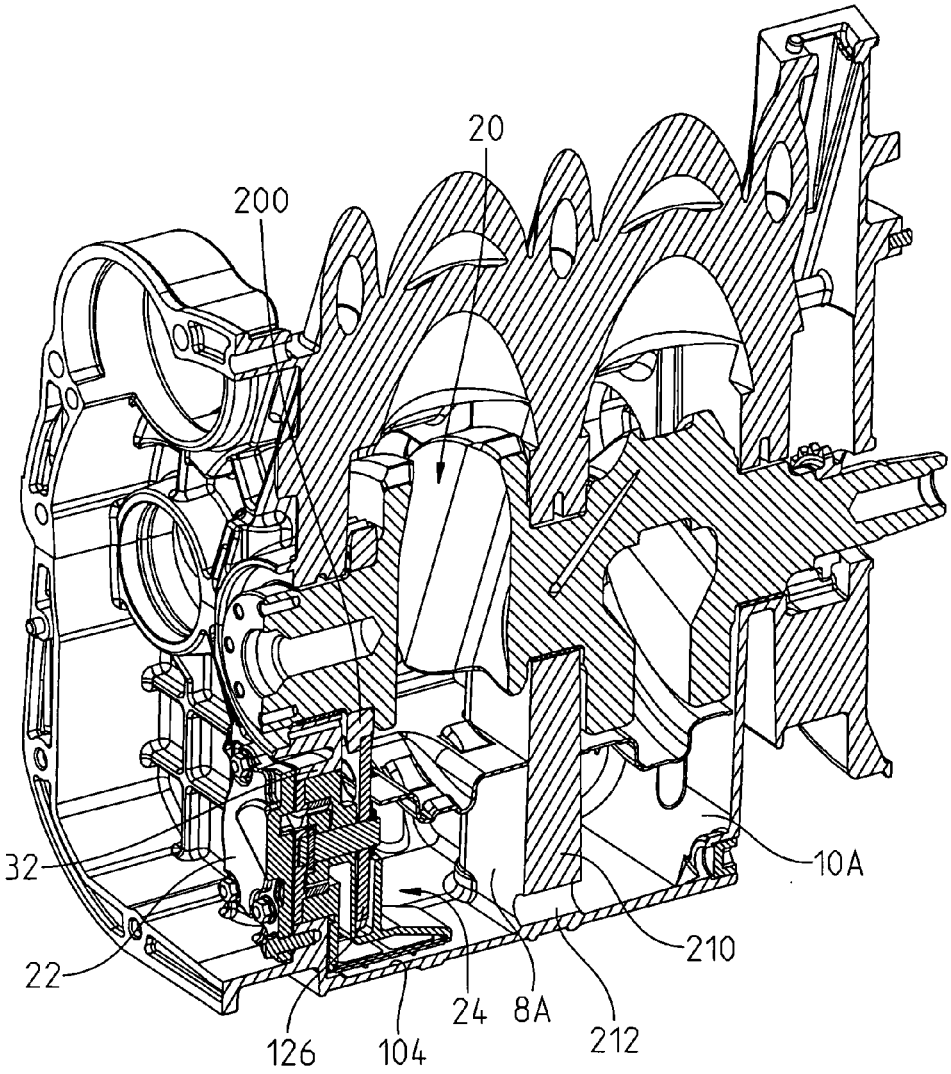
FIG. 9 shows a longitudinal cross-section through the engine and the oil pump.

As installed, the upright body portion 134 (FIG. 4) of the pump housing 120 is received in the recess 102 (FIG. 6) of the crankcase wall 14 as best shown in FIG. 7. As installed, discharge slot 190 of pump cover 128 is aligned with the slot 54 of pump cap 22. Furthermore, discharge slot 58 has been aligned with supply opening 30 and thereafter to oil regulator 110 as described above. Crankshaft 20 is now positioned in the corresponding journals of crankcase 6, with drive gear 200 is in meshing engagement with driven gear 126 as shown in FIG. 9. As pump 24 is tucked into recess 104, the pump 24 provides a low profile arrangement allowing clearance for the crankshaft to rotate, as best viewed in FIG. 9.

Thus, due to the geometry of the oil pump 24 together with the geometry of the crankcase, the engine can operate at extreme angles both front to back and side to side, in fact, can operate nose up to 65°, nose down to 35°, and side to side at 45°. This is accomplished at least in part by the crankcase 6 and head 4 being designed to allow complete drainage of oil, and to prevent excessive pooling of oil.

Figure 10:
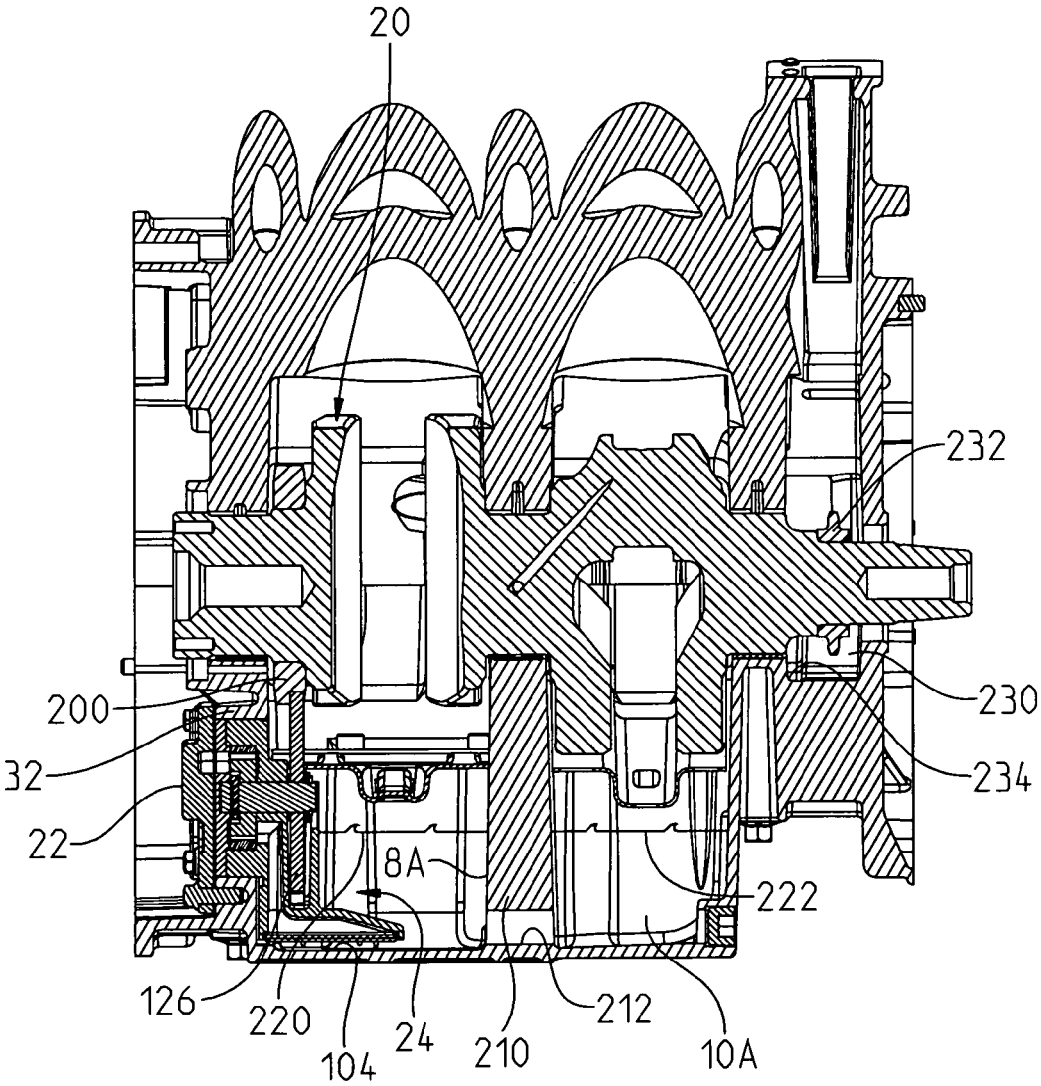
FIG. 10 shows a cross-sectional view similar to that of FIG. 9, but as a side section.
Figure 11:
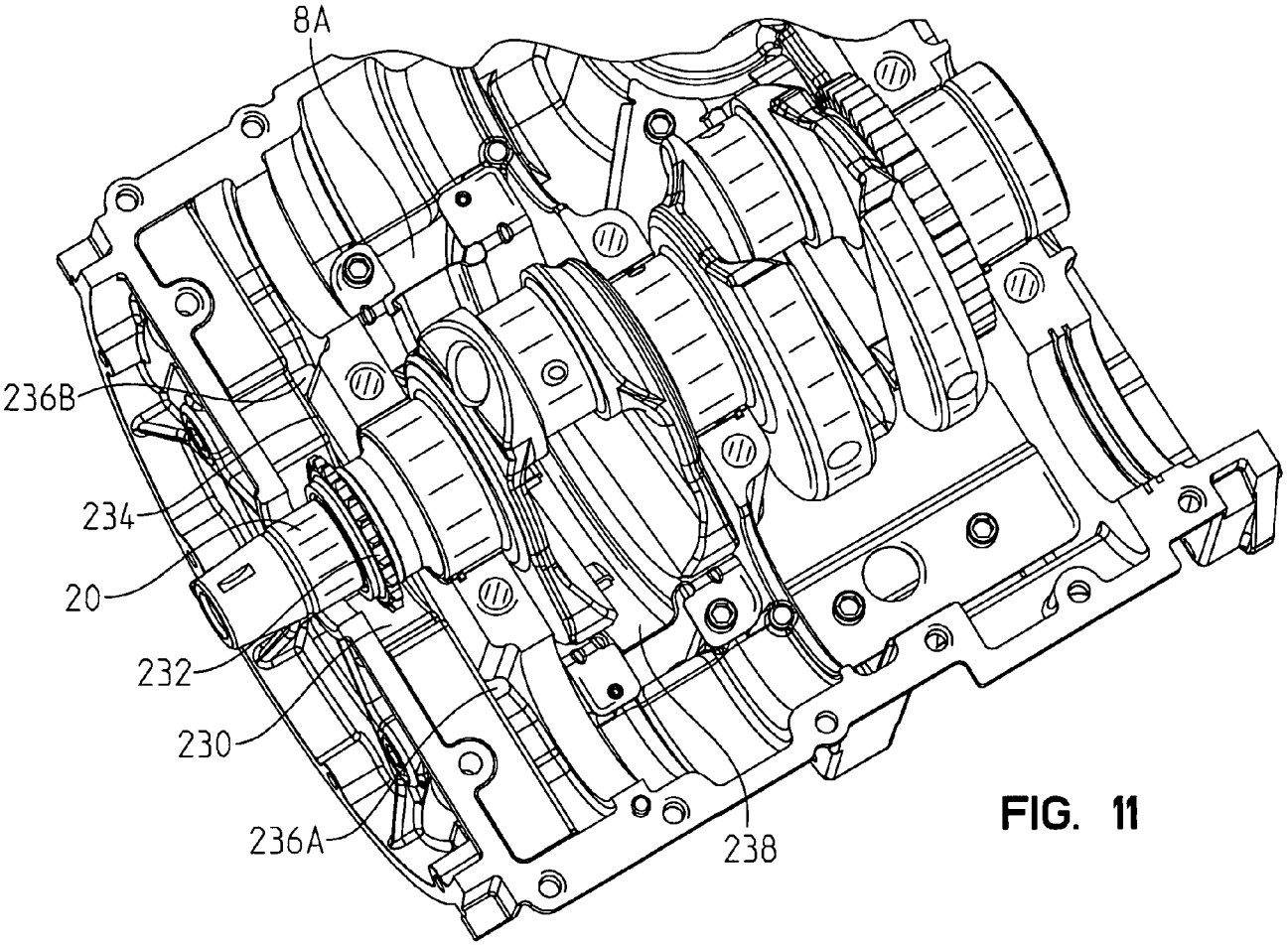
FIG. 11 shows a partial perspective cutaway of the camshaft sprocket guide.

More particularly and with reference to FIGS. 9 and 10, the crankshaft compartments 8A and 10A are separated by a mid wall 210 which defines the two compartments. The two compartments 8A, 10A have fluid communication by way of conduit 212. Compartment 10A is smaller than compartment 8A and in fact is roughly ⅓ the total volume of the two compartments together. Furthermore, and with reference to FIGS. 10 and 11, the crankcase 6 and head 4 define a camshaft tunnel 230 for camshaft 232. A transverse channel 234 is positioned inward of tunnel 230, and communicates with apertures 236A and 236B which empty back into compartment 8A. These apertures are positioned below the windage plate 238, and their function and operation are defined below.

Figure 10A:
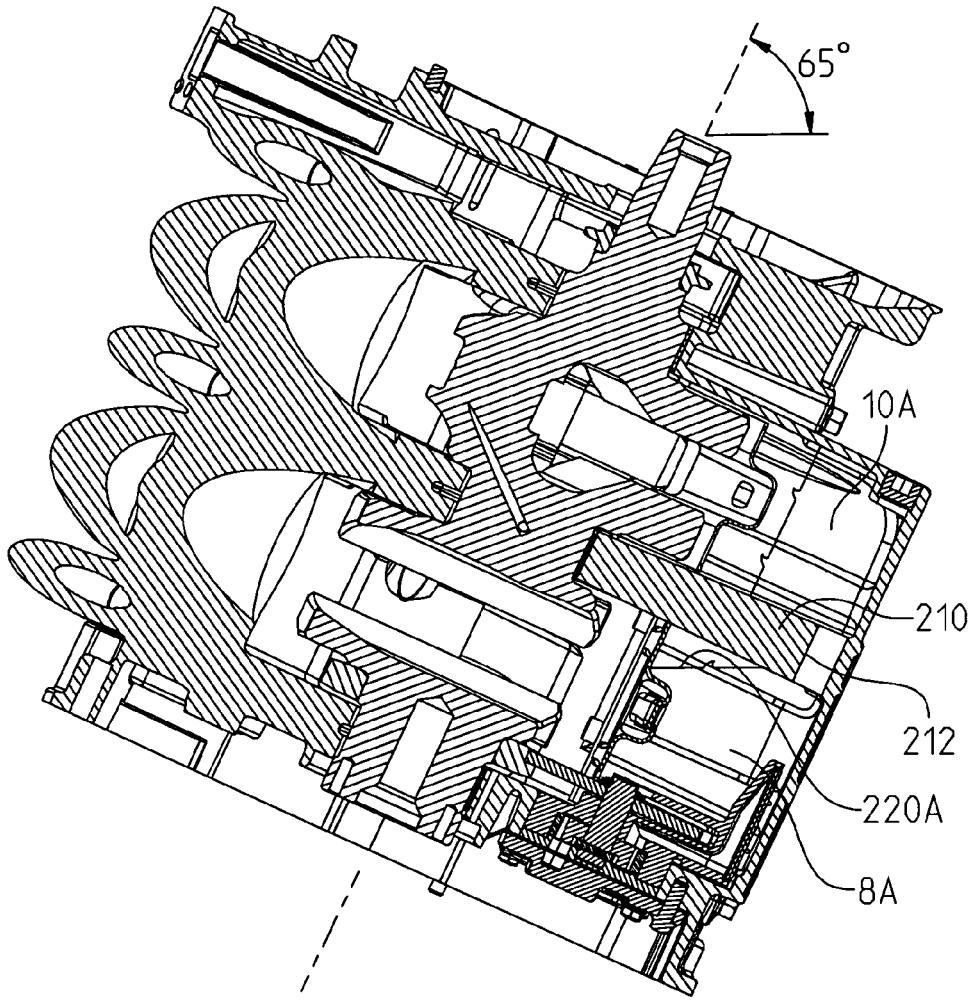
FIG. 10A shows a cross-sectional view similar to that of FIG. 10A, but when in the nose-up condition at 65°.

With reference first to FIG. 10, the engine 2 is shown in a level condition with oil levels of 220 and 222 being substantially level with each other, and which together would accumulate to approximately 2 quarts of motor oil. With respect now to FIG. 10A, the nose up condition at 65° is shown with the modified oil level shown in this condition, substantially all of the oil is shown in compartment 8A, having drained through the conduit 212. The conduit 212 does not impede oil transfer between the compartments 8A, 10A but rather prevents "sloshing" about in the crankcase.

Figure 10B:
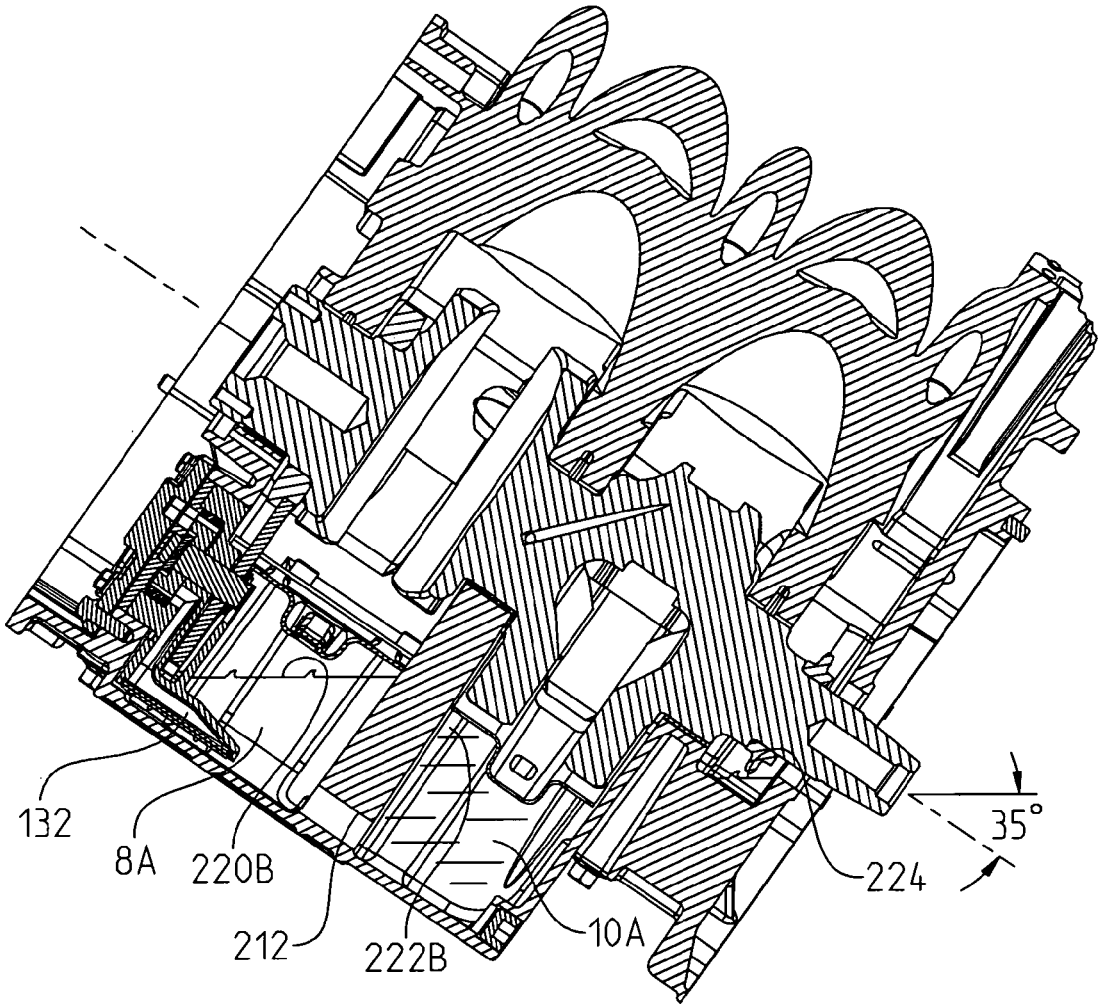
FIG. 10B shows a cross-sectional view similar to that of FIG. 10, but when in the nose-down condition at 35°.

With reference now to FIG. 10B, the vehicle is shown with nose down position at 35°. Due to the relative volume sizes of the compartments 8A and 10A, as mentioned above, the oil will never completely drain from the wet sump within crankcase compartment 8A. Furthermore, the oil pickup 132 is longitudinally over half the length of the oil sump in crank compartment 8A, and as shown is approximately 65%. As such, the oil pickup remains in the oil sump even when in the extreme nose down scenario.

Furthermore, due to the configuration of the camshaft tunnel 230 as described above, an excessive amount of oil will not pool there. That is, in the nose condition of FIG. 10B, compartment 10A is substantially filled at 22B, and compartment 8A is filled to the position 20B above the oil pickup 132. A small amount of oil pools to the level of 224, but the remainder drains through transverse channel 234 and through apertures 236 A and 236B back to the compartment 10A. It is also the location of apertures 236A and 236B which allows for the side to side engine movement of 45°.

What is claimed is:

1. An engine and pump assembly, comprising a crankcase having a crankcase wall with an opening therethrough, an oil pump body, a pumping member and an oil pump cap, the oil pump body and pumping member being positioned internally of the crankcase wall and the oil pump cap being positioned externally of the crankcase wall, the oil pump body having a sump member extending into an oil reservoir, and a pump case to receive the pumping member.

2. The engine and pump assembly of claim 1, further comprising a drive gear and drive gear shaft.

3. The engine and pump assembly of claim 2, further comprising a drive gear shield in which the drive gear rotates.

4. The engine and pump assembly of claim 3, wherein the drive gear shaft is at least partially journalled by the oil pump body.

5. The engine and pump assembly of claim 3, wherein the oil pump body, the oil pump case and the drive gear shield are an integral component.

6. The engine and pump assembly of claim 5, wherein the oil pump body, the oil pump case and the drive gear shield are comprised of die cast aluminum.

7. The engine and pump assembly of claim 6, wherein the oil pump cap is attached to the crankcase wall and to the oil pump body, which draws the oil pump cap against the crankcase wall, and the oil pump body against the oil pump cap.

8. The engine and pump assembly of claim 7, wherein the oil pump cap has a channel on an internal surface thereof, in fluid communication with a discharge side of the oil pump case.

9. The engine and pump assembly of claim 1, wherein the oil pumping member is a gerotor.

10. An oil pump assembly, comprising:

an oil pump body for insertion within a crankcase, the oil pump body having an integral oil sump member extending into an oil reservoir, and an integral pump case; and a pumping member receivable in the pump case, and being profiled to pump oil upon rotation thereof, the pumping member comprising a drive gear and drive gear shaft; and a drive gear shield to which the drive gear is rotatably fixed, and the drive gear partially protrudes though the drive gear shield.

11. The pump assembly of claim 10, wherein the drive gear shield is integrated with the oil pump body.

12. The pump assembly of claim 10, further comprising an oil pump cap wherein the oil pump body and pumping member are positioned internally of the crankcase wall and the oil pump cap being positioned externally of the crankcase wall.

13. The pump assembly of claim 12, wherein the drive gear shaft is at least partially journalled by the oil pump body.

14. The pump assembly of claim 11, wherein the oil pump body, the oil pump case and the drive gear shield are an integral die cast aluminum member.

15. The pump assembly of claim 10, wherein the oil pumping member is a gerotor.

16. An oil pump assembly, comprising:

an oil pump housing comprised of an upright housing portion, an oil pickup extending laterally from the upright housing portion and defining an oil pickup volume, a rotor housing, and a gear shield, the rotor housing being fluidly connected to the oil pickup through the upright housing portion;

a pumping member receivable in the rotor housing, and being profiled to pump oil upon pumping movement thereof;

a drive gear driving the pumping member; and a drive gear shield at least partially surrounding the drive gear and preventing the drive gear from being submersed into oil in the oil reservoir, wherein the upright housing portion integrally supports the drive gear shield, rotor housing, and gear shield.

17. The pump assembly of claim 16, further comprising a drive gear shaft, wherein the drive gear shaft is at least partially journalled by the oil pump body.

18. The pump assembly of claim 16, wherein the oil pump body, the oil pump case and the drive gear shield are an integral die cast aluminum member.

19. The pump assembly of claim 16, wherein the oil pumping member is a gerotor.

20. A four cycle engine, comprising:

a crankcase;

a crankshaft profiled for at least two connecting rods and pistons;

at least one mid wall separating the crankcase into at least two separate oil sumps;

one of the oil sumps being larger than the other;

a conduit connecting the two oil sumps; and an oil pump receivable in the larger of the oil sumps.

21. The engine of claim 20, wherein the engine is profiled for inline installation in a vehicle and the smaller of the oil sumps is in the front-most position with respect to vehicle direction.

22. The engine of claim 21, wherein the smaller of the oil sumps is profiled with one-third of the volume of the overall sump capacity.

23. An oil pump assembly, comprising:

an oil pump body and an oil pump case for insertion within a crankcase;

an oil sump member for extending into an oil reservoir;

a pumping member receivable in the pump case, and being profiled to pump oil upon pumping movement thereof;

a drive gear driving the pumping member; and a drive gear shield at least partially surrounding the drive gear and preventing the drive gear from being submersed into oil in the oil reservoir, wherein the oil pump body, the oil pump case and the drive gear shield are an integral die cast aluminum member.

24. The pump assembly of claim 23, further comprising a drive gear shaft, wherein the drive gear shaft is at least partially journalled by the oil pump body.

25. The pump assembly of claim 23, wherein the oil pumping member is a gerotor.

* * * * *